US007535160B2

(12) United States Patent
Jeon et al.

(10) Patent No.: US 7,535,160 B2
(45) Date of Patent: May 19, 2009

(54) ELECTRON EMISSION DEVICE AND ELECTRON EMISSION DISPLAY HAVING THE ELECTRON EMISSION DEVICE

(75) Inventors: Sang-Ho Jeon, Kyunggi-do (KR); Sang-Jo Lee, Kyunggi-do (KR); Jin-Hui Cho, Kyunggi-do (KR); Sang-Hyuck Ahn, Kyunggi-do (KR); Su-Bong Hong, Kyunggi-do (KR); Byung-Gil Jea, Kyunggi-do (KR)

(73) Assignee: Samsung SDI Co., Ltd., Suwon-si, Gyeonggo-do (KR)

( * ) Notice: Subject to any disclaimer, the term of this patent is extended or adjusted under 35 U.S.C. 154(b) by 0 days.

(21) Appl. No.: 11/585,126

(22) Filed: Oct. 24, 2006

(65) Prior Publication Data

US 2007/0138938 A1 Jun. 21, 2007

(30) Foreign Application Priority Data

Oct. 24, 2005 (KR) ..... 10-2005-0100195

(51) Int. Cl.

| | |
|---|---|
| ***H01J 1/62*** | (2006.01) |
| ***H01J 9/24*** | (2006.01) |
| *H01J 63/04* | (2006.01) |
| *H01J 1/02* | (2006.01) |

(52) U.S. Cl. ..... 313/310; 313/495; 313/498; 313/309; 313/311

(58) Field of Classification Search ..... 313/495–497, 313/306, 309–310

See application file for complete search history.

(56) References Cited

U.S. PATENT DOCUMENTS

| | | | | |
|---|---|---|---|---|
| 5,838,095 | A * | 11/1998 | Tanaka et al. | 313/309 |
| 6,420,827 | B1 * | 7/2002 | Lee et al. | 313/496 |
| 6,534,913 | B1 * | 3/2003 | Perrin et al. | 313/497 |
| 6,657,376 | B1 * | 12/2003 | Raina et al. | 313/496 |
| 6,727,642 | B1 * | 4/2004 | Cho et al. | 313/496 |
| 2002/0175607 | A1 * | 11/2002 | Hofmann et al. | 313/309 |
| 2004/0071006 | A1 * | 4/2004 | Ito et al. | 365/118 |
| 2004/0140755 | A1 * | 7/2004 | Lee et al. | 313/496 |
| 2005/0116214 | A1 * | 6/2005 | Mammana et al. | 257/10 |
| 2005/0116612 | A1 * | 6/2005 | Oh | 313/497 |
| 2005/0194887 | A1 * | 9/2005 | Ahn et al. | 313/495 |
| 2005/0197032 | A1 * | 9/2005 | Lee et al. | 445/24 |
| 2005/0200266 | A1 * | 9/2005 | Nomura | 313/495 |
| 2006/0113889 | A1 * | 6/2006 | Lee et al. | 313/495 |

* cited by examiner

*Primary Examiner*—Sikha Roy
*Assistant Examiner*—Tracie Y Green
(74) *Attorney, Agent, or Firm*—Lee & Morse, P.C.

(57) ABSTRACT

An electron emission device that includes a substrate, at least one electron emission region, and at least one cathode electrode disposed on the substrate and electrically connected to the electron emission region, wherein the cathode electrode has a first electrode, a plurality of second electrodes on the first electrode, a sub-insulation layer between the first and second electrodes, and a resistive layer electrically connected to the first and second electrodes.

20 Claims, 5 Drawing Sheets

ELECTRON EMISSION DEVICE AND ELECTRON EMISSION DISPLAY HAVING THE ELECTRON EMISSION DEVICE

BACKGROUND OF THE INVENTION

1. Field of the Invention

The present invention relates to an electron emission device and an electron emission display employing the same. In particular, the present invention relates to an electron emission device having enhanced electron emission uniformity.

2. Description of the Related Art

In general, electron emission devices refer to devices that extract electrons from a cathode electrode, hot or cold, into vacuum. Such devices may be combined with a light emission unit and an anode electrode to form electron emission displays.

Electron emission devices employing cold cathodes refer to devices having cathode electrodes that, instead of employing heat, emit electrons by application of a strong electric field, i.e., drive voltage, between the cathode and gate electrodes. An arrangement of a plurality of such cathode and gate electrodes on a substrate with electron emission regions therebetween may form an electron emission device. The arrangement of cathode and gate electrodes with electron emission regions therebetween may also be referred to as electron emission elements, while overlapping regions of the cathode and gate electrodes may be referred to as pixel units. Electron emission elements in cold cathode electron emission devices may include Field Emitter Array (FEA) elements, Surface Conduction Emitter (SCE) elements, Metal-Insulator-Metal (MIM) elements, and Metal-Insulator-Semiconductor (MIS) elements.

The drive voltage applied between the cathode and gate electrodes should be stable to minimize voltage difference, i.e., voltage drop, between electron emission regions of the pixel units to provide uniform electron emission, and, subsequently, uniform light emission in the pixel units. Such voltage stability may be achieved by increasing the number of electron emission regions at each pixel unit or application of a resistive layer between the cathode electrode and the electron emission region in order to control an intensity of the current. In particular, the cathode electrode may include first and second electrodes attached to the same plane and interconnected by a resistive layer, such that the electron emission region may be formed on either the first or the second electrode.

However, when a resistive layer is employed in conventional electron emission devices, the first electrode may be provided with contact openings, such that an effective width, i.e., an electrode width contributing to a current flow in a unit pixel, of the first electrode may be reduced, thereby increasing a line resistance of the first electrode relative to that of the second electrode. Such a difference in line resistance between the first and second electrodes may reduce the electron emission uniformity despite the use of a resistive layer, thereby decreasing the light emission uniformity in the pixel units along the length of the first electrode of the electron emission display.

Accordingly, there exists a need to improve the structure of the electron emission device in order to provide sufficient voltage stability therein and maintain proper light emission uniformity and electrical operation of the electron emission display.

SUMMARY OF THE INVENTION

The present invention is therefore directed to an electron emission device and an electron emission display employing the same, which substantially overcome one or more of the disadvantages of the related art.

It is therefore a feature of an embodiment of the present invention to provide an electron emission device having enhanced electron emission uniformity.

It is therefore another feature of an embodiment of the present invention to provide an electron emission display having an electron emission device capable of providing enhanced light emission uniformity.

At least one of the above and other features and advantages of the present invention may be realized by providing an electron emission device, including a substrate; at least one cathode electrode disposed on the substrate and having a first electrode, a plurality of second electrodes on the first electrode, a sub-insulation layer between the first and second electrodes, and a resistive layer electrically connected to the first and second electrodes; and at least one electron emission region electrically connected to the cathode electrode.

The first electrode may have a width greater than a width of the second electrode.

The resistive layer may be coupled between edges of the first electrode and the second electrodes. Additionally, the resistive layer may include a material having a resistivity of from about 10,000 Ωcm to about 100,000 Ωcm.

The at least one electron emission region may be interposed on a respective second electrode. Additionally, the at least one electron emission region may include any one of carbon nanotubes, graphite, graphite nanofibers, diamonds, diamond-like carbon, $C_{60}$, silicon nanowires, or a combination thereof.

The electron emission device of the present invention may further include at least one gate electrode. The at least one gate electrode may overlap with the at least one cathode electrode. Additionally, the sub-insulation layer and the second electrodes may be positioned in an overlap area between the gate electrode and the first electrode.

The electron emission device of the present invention may further include a focusing electrode. Additionally, the electron emission device of the present invention may include a plurality of cathode electrodes.

In another aspect of the present invention, there is provided an electron emission display, including first and second substrates; at least one cathode electrode disposed on the first substrate having a first electrode, a plurality of second electrodes on the first electrode, a sub-insulation layer between the first and second electrodes, and a resistive layer electrically connected to the first and second electrodes; at least one electron emission region electrically connected to the cathode electrode; and a light emission unit.

The first electrode may have a width greater than a width of the second electrode.

The resistive layer may be coupled between edges of the first electrode and the second electrodes. Additionally, the resistive layer may include a material having a resistivity of from about 10,000 Ωcm to about 100,000 Ωcm.

The light emission unit may include a plurality of phosphor layers, a plurality of black layers, and an anode electrode. The plurality of phosphor and black layers may be disposed adjacent to one another. The cathode electrode, the at least one electron emission region, and the light emission unit may be disposed between the first and second substrates.

The electron emission display of the present invention may further include a gate electrode overlapping with the cathode electrode. Additionally, the electron emission display of the present invention may include a focusing electrode.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
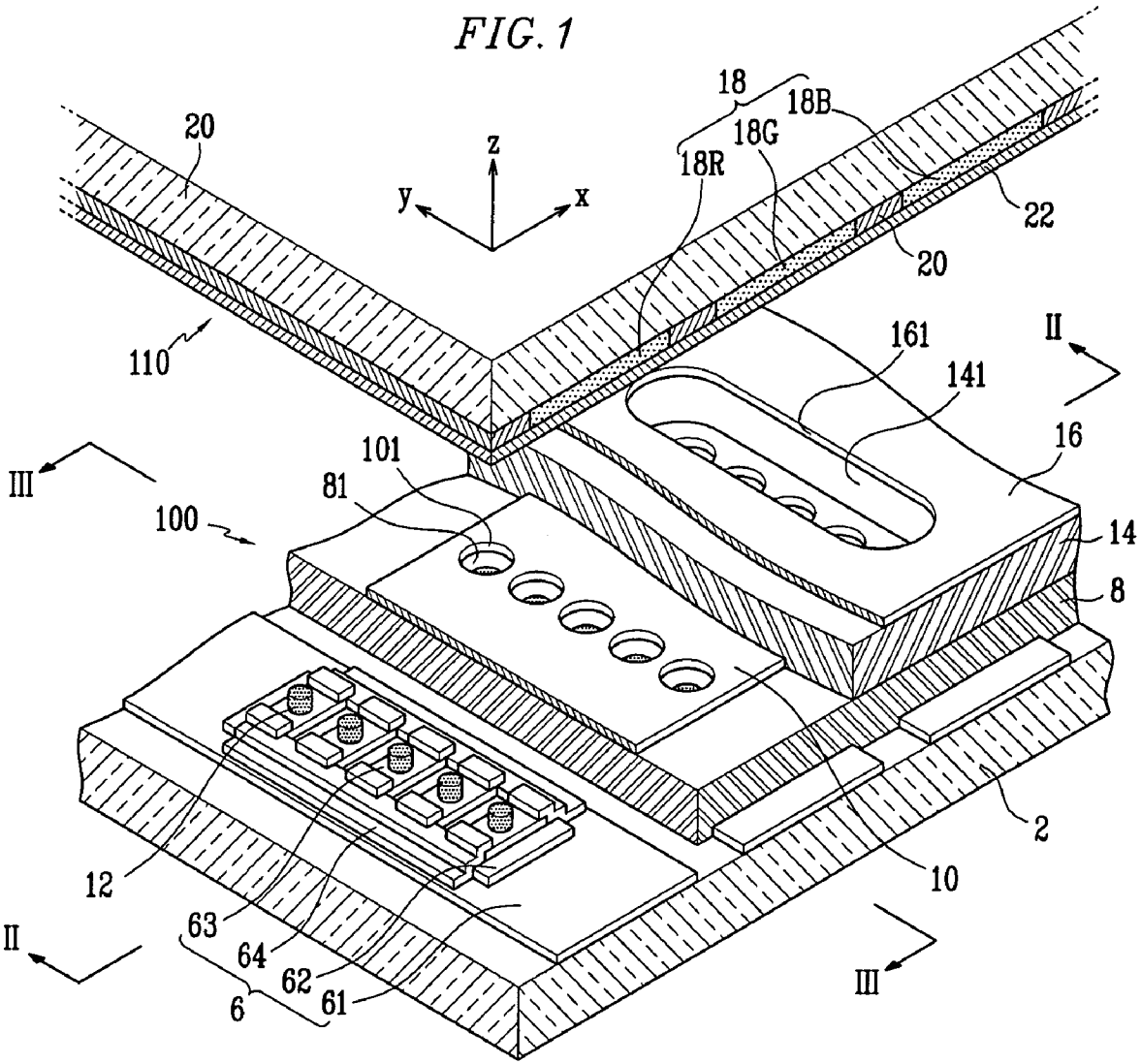
FIG. 1 illustrates a partially exploded perspective view of an electron emission display according to an embodiment of the present invention.

Korean Patent Application No. 10-2005-0100195, filed on Oct. 24, 2005, in the Korean Intellectual Property Office, and entitled "Electron Emission Element and Electron Emission Device Having the Same," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

It will further be understood that when an element is referred to as being "on" another element or substrate, it can be directly on the other element or substrate, or intervening elements may also be present. Further, it will be understood that when an element is referred to as being "under" another element, it can be directly under, or one or more intervening elements may also be present. In addition, it will also be understood that when an element is referred to as being "between" two elements, it can be the only element between the two elements, or one or more intervening elements may also be present. Like reference numerals refer to like elements throughout.

An exemplary embodiment of an electron emission display according to the present invention is more fully described below with reference to FIGS. 1-4. As illustrated in FIGS. 1-4, an electron emission display according to an embodiment of the present invention may include an electron emission device 100, a light emission unit 110, and a sealing member (not shown) to attach the light emission unit 110 to the electron emission device 100, such that a predetermined, pressure-controlled space is formed therebetween, i.e., vacuum environment having pressure of about $10^{-6}$ torr. In this respect, it should be noted that the electron emission display according to an embodiment of the present invention may include different types of electron emission elements. Accordingly, even though in the following exemplary embodiment of an electron emission display an array of FEA elements is described, other types of electron emission elements, e.g., SCE, MIM, or MIS, are not excluded from the scope of the present invention.

The electron emission device 100 of the electron emission display according to an embodiment of the present invention may include a plurality of electron emission elements on a surface of a substrate. More specifically, the electron emission device 100 may include a first substrate 2, a plurality of cathode electrodes 6, a plurality of gate electrodes 10, a first insulation layer 8 positioned between the cathode electrodes 6 and the gate electrodes 10, and at least one electron emission region 12.

The plurality of cathode electrodes 6 may be formed on the first substrate 2 in an array, such that the plurality of cathode electrodes 6 may be parallel to one another and perpendicular to the x-axis, as illustrated in FIG. 1. Each of the plurality of cathode electrodes 6 may include a first electrode 61, a plurality of second electrodes 63, a sub-insulation layer 62 formed between the first electrode 61 and the plurality of second electrodes 63, and a resistive layer 64 connecting the first electrode 61 to the plurality of second electrodes 63.

The first electrode 61 may be formed in a longitudinal shape, e.g., rectangle, on the first substrate 2 along a y-axis, as illustrated in FIG. 1. More specifically, the first electrode 61 may be formed to have no openings and a uniform width, i.e., a distance as measured along the x-axis. The first electrode 61 may be formed of a transparent conductive material such as indium tin oxide (ITO) or indium zinc oxide (IZO).

The sub-insulation layer 62 of the cathode electrode 6 according to an embodiment of the present invention may be formed along a length, i.e., a distance as measured along the y-axis, of the first electrode 61 to have a length and a width smaller than a length and a width of the first electrode 61 to partly expose a surface thereof.

The plurality of second electrodes 63 of the cathode electrode 6 according to an embodiment of the present invention may be arranged on the sub-insulation layer 62 in an array along the first electrode 61, such that the sub-insulation layer 62 may be positioned between the first electrode 61 and the plurality of second electrodes 63. Each second electrode 63 may be parallel to one another and the x-axis, i.e., each second electrode 63 may have its longer side positioned parallel to the width of the first electrode 61. Additionally, each of the plurality of second electrodes 63 may be formed to have a width that is smaller than a width of the sub-insulation layer 62. However, other embodiments are not excluded from the scope of the present invention. For example, the width of each of the plurality of second electrodes 63 may be equal to the width of the sub-insulation layer 62.

Figure 2:
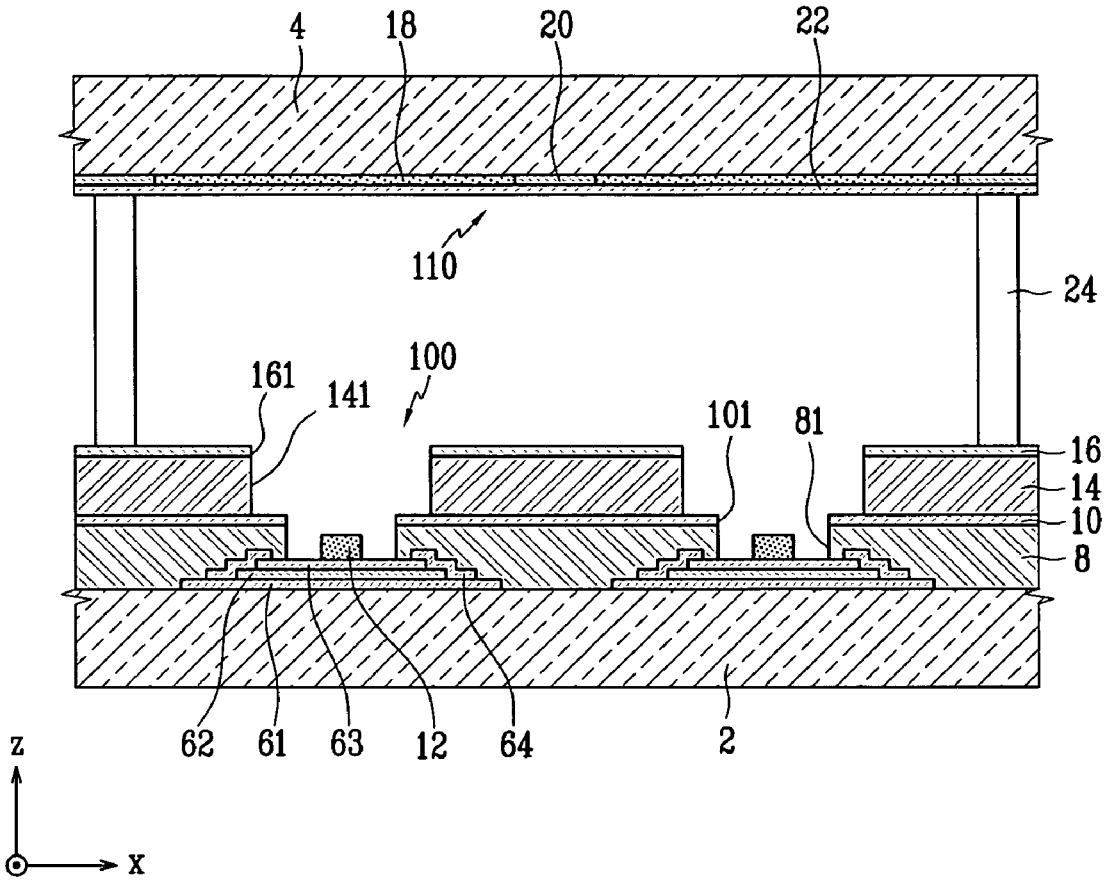
FIG. 2 illustrates a cross-sectional view along line II-II of FIG. 1.

The resistive layer 64 of the cathode electrode 6 according to an embodiment of the present invention may be applied to peripheral areas, i.e., areas located on the xy-plane along the y-axis, of the first electrode 61 and respective peripheral areas of the plurality of second electrodes 63 to form a connection therebetween, as illustrated in FIG. 2. However, other types of contacts between the first electrode 61 and the plurality of second electrodes 63 via the resistive layer 64 are not excluded from the scope of the present invention. For example, the resistive layer 64 may be applied to side edges, i.e., surfaces located in the yz-plane, of the plurality of second electrodes 63 in order to form small contact areas between the resistive layer 64 and the plurality of second electrodes 63. The resistive layer 64 may be formed of a material having resistivity of from about 10,000 Ωcm to about 100,000 Ωcm, e.g., amorphous silicon doped with P-type or N-type impurities, to provide the resistive layer 64 with resistance that may be lower than the resistance of the cathode electrode 6.

The first insulation layer 8 of the electron emission device 100 according to an embodiment of the present invention may be formed on the first substrate 2, such that the plurality of cathode electrodes 6 may be positioned therebetween.

The plurality of gate electrodes 10 of the electron emission device 100 according to an embodiment of the present invention may be formed on the first insulation layer 8 in an array, such that the plurality of gate electrodes 10 may be parallel to one another and perpendicular to the x-axis, as illustrated in FIG. 1. In other words, the plurality of gate electrodes 10 and the plurality of cathode electrodes 6 may be positioned in parallel directions above each other to form overlapping regions therebetween. Each such overlapping region between one cathode electrode 6 and one gate electrode 10 may define a pixel unit. In this respect, it should be noted that the sub-insulation layer 62 and the plurality of second electrodes 63 of each of the plurality of cathode electrodes 6 may be formed within the pixel unit of emission element.

Figure 4:
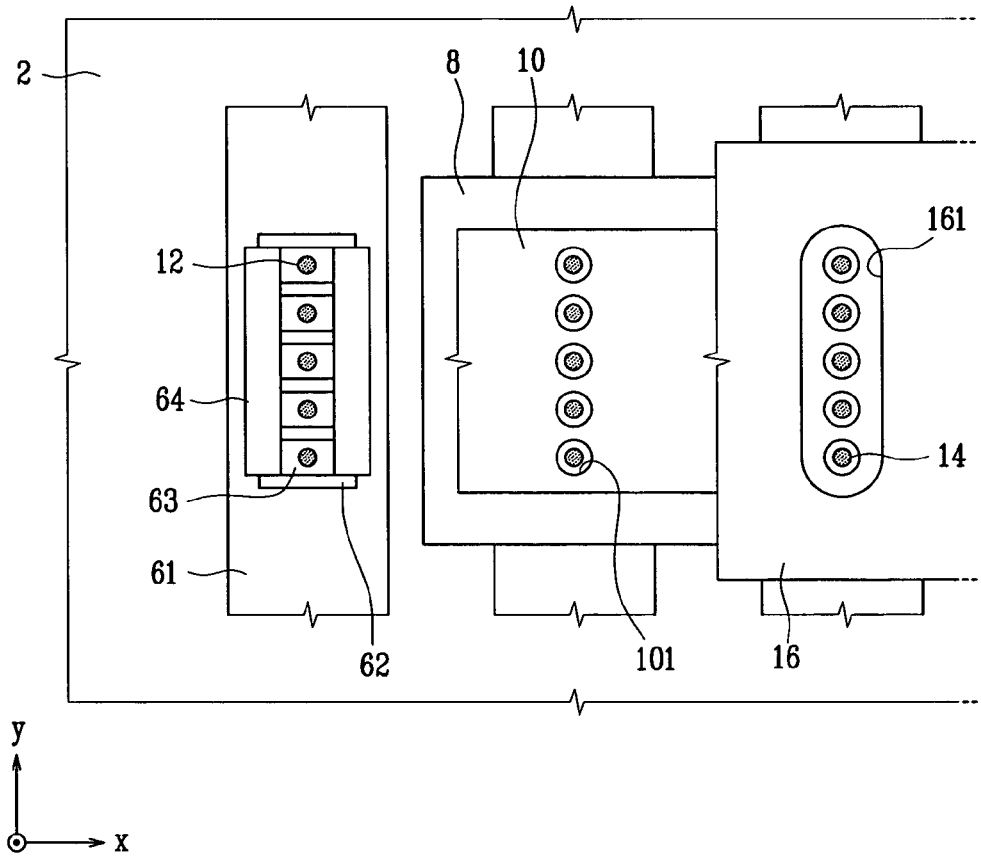
FIG. 4 illustrates a partial top view of the electron emission display illustrated in FIG. 1.

In particular, the sub-insulation layer 62 may be divided into a plurality of sections formed in each pixel unit. For example, as illustrated in FIG. 4, five rectangular second electrodes 63 may be arranged in parallel to one another on each section of the sub-insulation layer 62 along the length of the cathode electrode 6. It should be noted, however, that the shape, number and configuration of the resistive layer 64 may be changed with respect to a determination of one of ordinary skill in the art.

The at least one electron emission region 12 of the electron emission device 100 according to an embodiment of the present invention may be formed on the plurality of second electrodes 63. Preferably, a plurality of electron emission regions 12 may be formed on each cathode electrode 6 within the pixel unit, such that each electron emission region 12 may be formed on a respective second electrode 63.

The emission regions 12 may be formed of any material having a low work function or a large aspect ratio and is capable of emitting electrons upon application of electric field thereto in a vacuum environment, e.g., carbonaceous material, nanometer-sized material, and so forth. For example, the electron emission regions 12 may be formed of carbon nanotubes, graphite, graphite nanofibers, diamonds, diamond-like carbon, $C_{60}$, silicon nanowires, a molybdenum-based material, a silicon-based material, or a combination thereof. If the electron emission regions 12 are formed of a molybdenum-based material or a silicon-based material, the electron emission regions 12 may be formed to have a pointed-tip structure.

The electron emission device 100 of the electron emission display according to an embodiment of the present invention may further include a first opening 81 and a second opening 101 that may be formed on the first insulation layer 8 and the gate electrodes 10, respectively, to expose the electron emission regions 12, such that emitted electrons may move from the electron emission regions 12 upward through the first and second openings 81 and 101, respectively. In other words, the first and second openings 81 and 101 may be formed directly above the electron emission regions 12. The first opening 81, the second opening 101, and the electron emission regions 12 may be formed to have any convenient shape, e.g., circular, as determined by one of ordinary skill in the art.

The electron emission device 100 of the electron emission display according to an embodiment of the present invention may also include a second insulation layer 14. The second insulation layer 14 may be formed on the first insulation layer 8, such that the plurality of gate electrodes 10 may be positioned therebetween.

The electron emission device 100 of the electron emission display according to an embodiment of the present invention may also include at least one focusing electrode 16. The focusing electrode 16 may be formed of a single layer and have a predetermined size. The focusing electrode may be formed on the second insulation layer 14, such that the second insulation layer 14 may be positioned between the plurality of gate electrodes 10 and the at least one focusing electrode 16 to separate therebetween.

The electron emission device 100 of the electron emission display according to an embodiment of the present invention may further include a third opening 141 and a fourth opening 161 that may be formed through the second insulation layer 14 and the focusing electrode 16, respectively, to provide a path for electron beams from the electron emission regions 12. In particular, each pixel unit may include a plurality of third openings 141, such that each third opening 141 may be formed to correspond to a respective electron emission region 12. On the other hand, each unit pixel may have only one fourth opening 161, as illustrated in FIG. 1, to facilitate electron beam focus through the focusing electrode 16. The fourth opening 161 may be formed along the length of the focusing electrode 16, i.e., y-axis, to expose the plurality of electron emission regions 12 of each pixel unit.

The light emission unit 110 of the electron emission display according to an embodiment of the present invention may include a plurality of light emitting elements on a substrate. More specifically, the light emission unit 110 may include a plurality of phosphor layers 18, a plurality of black layers 20, and an anode electrode 22 positioned on a second substrate 4.

The plurality of phosphor layers 18 may be formed of any known phosphorescent material emitting red, green and blue light. The red, green, and blue phosphor layers 18R, 18G and 18B, respectively, may be disposed on a surface of the second substrate 4, e.g., each red, green, and blue phosphor layer 18R, 18G and 18B, respectively, may be in communication with the second substrate 4.

Figure 3:
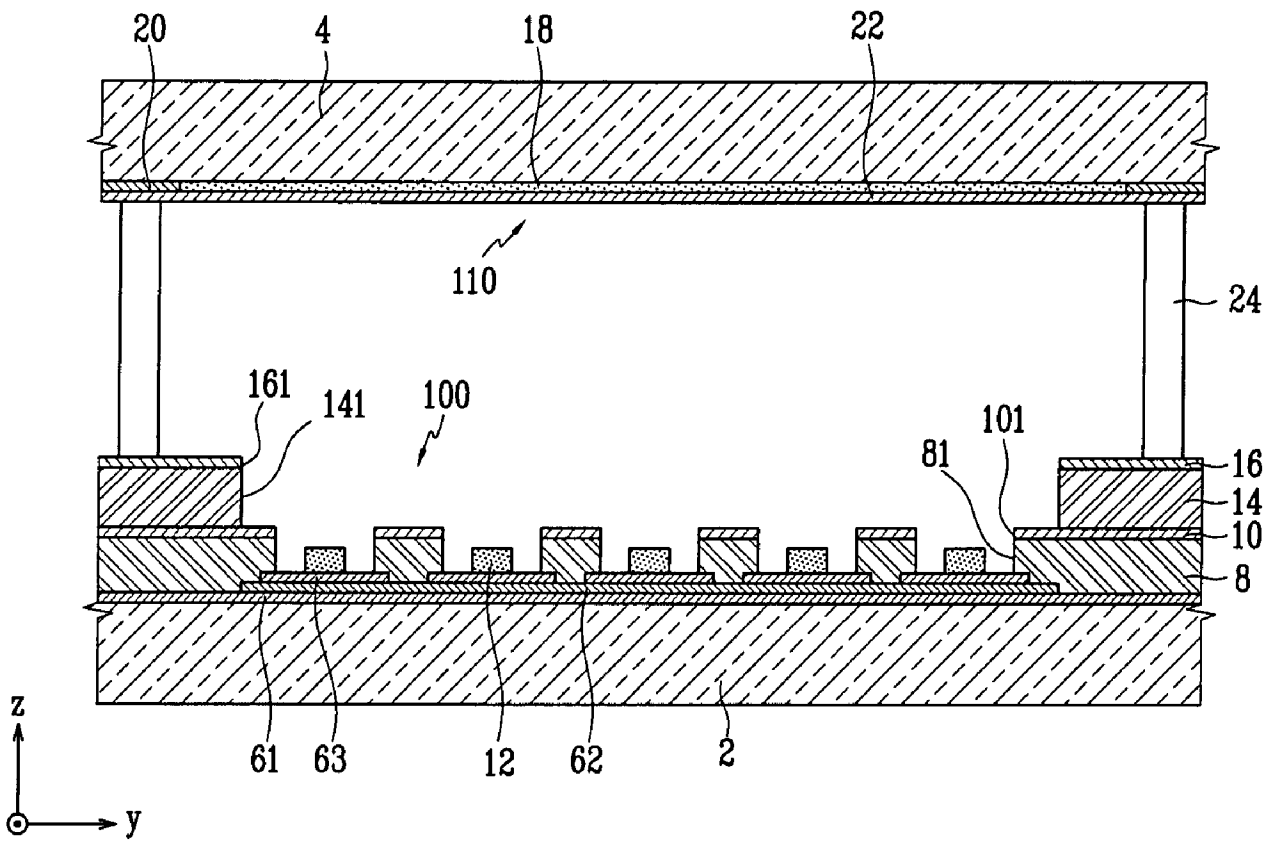
FIG. 3 illustrates a cross-sectional view along line III-III of FIG. 1.

The plurality of black layers 20 may be formed on the surface of the second substrate 4 to enhance the contrast of the screen. The plurality of black layers 20 may be formed adjacent to the phosphor layers 18, e.g., on the same plane between the green phosphor layer 18G and the blue phosphor layer 18B, as illustrated in FIG. 1-3, such that each black layer 20 may be in direct communication with the second substrate 4 and two phosphor layers 18.

The anode electrode 22 may be formed on the plurality of phosphor and black layers 18 and 20 in parallel thereto, i.e., on the xy-plane, such that the plurality of phosphor and black layers 18 and 20 may be positioned between the second substrate 4 and the anode electrode 22. For example, each phosphor layer 18 may be in communication with the second substrate 4, the anode electrode 22, and two black layers 20. Similarly, each black layer 20 may be in communication with the second substrate 4, the anode electrode 22, and two phosphor layers 18. The anode electrode 22 may receive high voltage and, thereby, facilitate acceleration of electron beams from the first substrate 2 to the second substrate 4 and generate visible light in the phosphor layers 18 to further increase screen luminance of the electron emission display.

The anode electrode 22 may be formed of any known conductive material as determined by one of ordinary skill in the art, e.g., aluminum, Indium Tin Oxide (ITO), and so forth. If the anode electrode 22 is formed of a transparent conductive material, e.g., ITO, the anode electrode 22 may be positioned directly on the second substrate 4, and the plurality of phosphor and black layers 18 and 20, respectively, may be disposed thereon, such that the anode electrode 22 may be positioned between the second substrate 4 and the plurality of phosphor and black layers 18 and 20. Alternatively, the anode electrode 22 may be formed of multiple conductive layers, e.g., a transparent conductive layer and a metallic layer.

The light emission unit 110 and the electron emission device 100 may be attached by connecting the second substrate 4 of the light emission unit 110 to the first substrate 2 of the electron emission device 100 via the sealing member of the electron emission display. In particular, the sealing member may be applied to peripheral areas of the first substrate 2 and/or second substrate 4 to facilitate attachment thereof at a predetermined distance, such that the plurality of electron emitting elements of the electron emission device 100 and the plurality of light emitting elements of the light emission unit 110 may be positioned therebetween to face one another. For example, when the electron emission device 100 and the light emission unit 110 are attached, the plurality of phosphor layers 18 formed on the second substrate 4 of the light emission unit 110 may be positioned directly across from respective pixel units on the first substrate 2, such that an electron beam from each electron emission region 12 of the electron emission device 100 may have a direct path from the electron emission device 100 to its respective phosphor layer 18.

The electron emission display according to an embodiment of the present invention may also include spacers 24. The spacers 24 may be disposed between the first and second substrates 2 and 4, respectively, to maintain the predetermined distance between the first and second substrates 2 and 4. Each spacer 24 may be positioned to correspond to the black layer 20. In other words, a contact plane between each spacer 24 and the light emission unit 110 may be within a width of a respective black layer 20 in order to prevent any overlap between the spacer 24 and the phosphor layers 18 and, thereby, minimize interference with light emission from the plurality of phosphor layers 18.

The electron emission display according to an embodiment of the present invention may be driven by application of a predetermined voltage to the plurality of cathode electrodes 6, plurality of gate electrodes 10, focusing electrodes 16, and anode electrode 22. For example, one of the cathode electrodes 6 may function as a scan electrode receiving a scan drive voltage, while a respective gate electrode may function as a data electrode receiving a data drive voltage. Alternatively, the functions of the cathode electrode 6 and the gate electrode 10 may be switched.

Further, the focus electrode 16 may receive a negative direct current voltage, e.g., 0 or several to tens volts, and the anode electrode 22 may receive a positive direct current voltage, e.g., hundreds to thousands volts, to facilitate acceleration of electron beams.

Without intending to be bound by theory, it is believed that application of voltage as described above may provide a voltage difference between the cathode and gate electrodes 6 and 10, respectively, that is equal to or higher than a predetermined threshold value, thereby facilitating formation of an electric field around the electron emission regions 12 of each pixel unit having such voltage difference. Formation of such an electric field may, consequently, facilitate emission of electrons from the electron emission regions 12. The emitted electrons may be attracted by the high voltage applied to the anode electrode 22, thereby striking the corresponding phosphor layers 18 to trigger an excitation state thereof and generate light emission.

Without intending to be bound by theory, it should further be noted that upon voltage application to the electron emission display, an intensity of a current applied to each electron emission element may be controlled by the resistive layer 64 to provide uniform electron emission from each electron emission element. Further, the electric field intensity around each electron emission region 12 may be maintained uniform regardless of the voltages, i.e., employing different voltages, applied to the first and second electrodes 61 and 63 because the first and second electrodes 61 and 63 of the cathode electrode 6 are disposed on different planes, thereby facilitating the focus of the electron emission beam and minimizing secondary light emission to improve color reproduction of the electron emission display.

EXAMPLES

An electron emission display according to an embodiment of the present invention was formed (Example 1) and compared to a conventional electron emission display employed in a Cathode-Ray Tube (CRT) of the National Television System Committee (NTSC) (Comparative Example 1) in terms of color coordinates according to the color scale of the Commission Internationale de l'Eclairage (CIE) and reproduction thereof. The comparison results are summarized below in Table 1.

TABLE 1

| | Example 1 | | Comparative Example 1 | |
|---|---|---|---|---|
| Color coordinates | x | y | x | y |
| Red | 0.635 | 0.335 | 0.575 | 0.354 |
| Green | 0.275 | 0.605 | 0.287 | 0.524 |
| Blue | 0.142 | 0.065 | 0.165 | 0.105 |
| Color Reproduction | 72.8% | | 44.7% | |

As can be seen in Table 1, the color coordinates in Example 1 have values that are closer to pure red, green, and blue colors as compared to the color coordinates of the Comparative Example 1. Accordingly, the color reproduction upon combination of the red, green, and blue colors in Example 1 exhibits a value of 72.8% as compared to the value of 44.7% obtained in the Comparative Example 1. Without intending to be bound by theory, it is believed that minimized secondary light emission in the electron emission display of the present invention provides the improved color reproduction of the electron emission display as compared with the conventional electron emission display.

Figure 5:
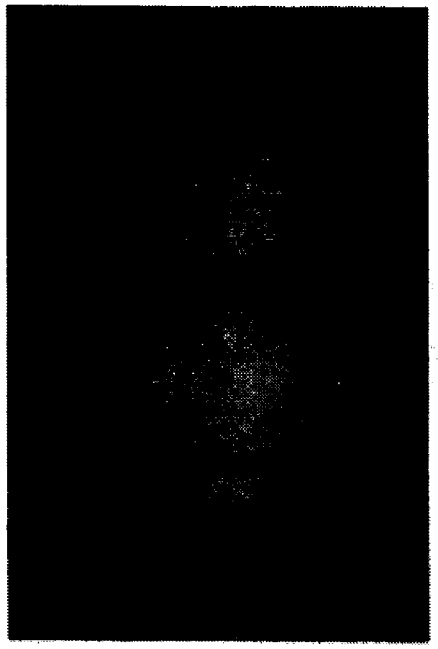
FIG. 5 illustrates a photograph of light emitting pixel unit of the electron emission display illustrated in FIG. 1.
Figure 6:
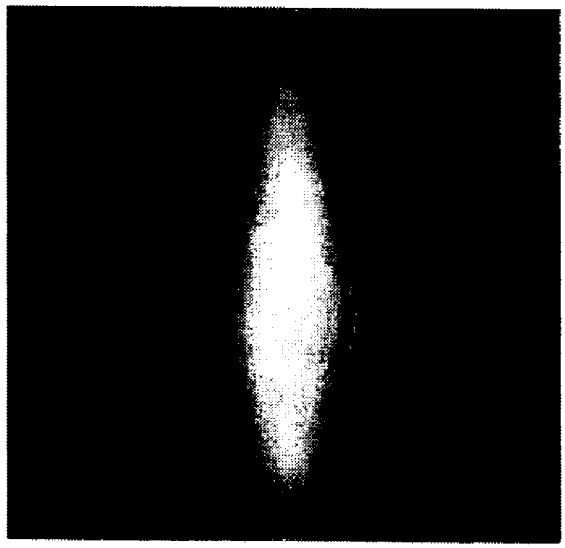
FIG. 6 illustrates a photograph of light emitting pixel unit of a conventional electron emission display.

The enhanced color reproduction of the electron emission display of the present invention is further illustrated in FIGS. 5-6, where a red pixel at a light emitting state in the electron emission display of the present invention is photographed in comparison to a red pixel at a light emitting state in a conventional electron emission display. As can be seen in the photographs, the color reproduction in the electron emission display of the present invention is enhanced as compared with the conventional electron emission display. Accordingly, the electron emission display of the present invention may provide uniform luminance and, thereby, overall enhanced quality.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An electron emission device, comprising:

a substrate;

at least one cathode electrode disposed on the substrate, the at least one cathode electrode including a first electrode, a plurality of second electrodes on the first electrode, a sub-insulation layer between the first and second electrodes, and a resistive layer on upper surfaces of and electrically connecting the first and second electrodes, the resistive layer including at least one uninterrupted portion in direct contact with an upper surface of the first electrode and in direct contact with an upper surface of at least one of the plurality of second electrodes; and an at least one electron emission region electrically connected to the cathode electrode.

2. The electron emission device as claimed in claim 1, wherein the first electrode has a width greater than a width of the second electrode.

3. The electron emission device as claimed in claim 1, wherein the resistive layer is coupled between peripheral regions of the first electrode and peripheral regions of the second electrodes.

4. The electron emission device as claimed in claim 1, wherein the resistive layer includes a material having a resistivity of from about 10,000 Ωcm to about 100,000 Ωcm.

5. The electron emission device as claimed in claim 1, further comprising at least one gate electrode.

6. The electron emission device as claimed in claim 5, wherein the at least one gate electrode overlaps with the at least one cathode electrode.

7. The electron emission device as claimed in claim 5, wherein the sub-insulation layer and the second electrodes are positioned in an overlap area between the gate electrode and the first electrode.

8. The electron emission device as claimed in claim 1, further comprising a focusing electrode.

9. The electron emission device as claimed in claim 1, further comprising a plurality of cathode electrodes.

10. The electron emission device as claimed in claim 1, wherein at least one electron emission region of a plurality of electron emission regions is interposed on a respective second electrode.

11. The electron emission device as claimed in claim 1, wherein the at least one electron emission region includes any one of carbon nanotubes, graphite, graphite nanofibers, diamonds, diamond-like carbon, $C_{60}$, silicon nanowires, or a combination thereof.

12. An electron emission display, comprising:

a first substrate;

at least one cathode electrode disposed on the first substrate, the at least one cathode electrode including a first electrode, a plurality of second electrodes on the first electrode, a sub-insulation layer between the first and second electrodes, and a resistive layer on upper surfaces of and electrically connecting the first and second electrodes, the resistive layer being in direct contact only with peripheral regions of the first electrode and peripheral regions of the second electrodes;

at least one electron emission region electrically connected to the cathode electrode; and a light emission unit.

13. The electron emission display as claimed in claim 12, wherein the first electrode has a width greater than a width of the second electrode.

14. The electron emission display as claimed in claim 12, wherein the resistive layer is coupled between peripheral regions of the first electrode and peripheral regions of the second electrodes.

15. The electron emission display as claimed in claim 12, wherein the resistive layer includes a material having a resistivity of from about 10,000 Ωcm to about 100,000 Ωcm.

16. The electron emission display as claimed in claim 12, further comprising at least one gate electrode overlapping with the at least one cathode electrode.

17. The electron emission display as claimed in claim 12, further comprising a focusing electrode.

18. The electron emission display as claimed in claim 12, wherein the light emission unit includes a second substrate, a plurality of phosphor layers, a plurality of black layers, and an anode electrode.

19. The electron emission display as claimed in claim 18, wherein the plurality of phosphor and black layers are disposed adjacent to one another.

20. The electron emission device as claimed in claim 3, wherein the resistive layer is in direct contact only with the peripheral regions of the first electrode and the peripheral regions of the second electrodes.

* * * * *